United States Patent [19]

Steele et al.

[11] Patent Number: 4,650,178

[45] Date of Patent: Mar. 17, 1987

[54] SELF-ALIGNING DOCUMENT STACKER

[75] Inventors: David Steele, Edinburgh; Robert G. Bradford, Bonnybridge, both of Scotland

[73] Assignee: Burroughs Corporation, Detroit, Mich.

[21] Appl. No.: 764,458

[22] Filed: Aug. 12, 1985

[30] Foreign Application Priority Data

Feb. 23, 1985 [GB] United Kingdom ..... 8504739

[51] Int. Cl.[4] ..... B65H 29/58

[52] U.S. Cl. ..... 271/305; 271/99; 271/184; 271/297; 271/902

[58] Field of Search ..... 271/305, 304, 303, 287, 271/288, 289, 228, 297, 274, 273, 177, 178, 188, 314, 99, 184, 902

[56] References Cited

U.S. PATENT DOCUMENTS

| | | | |
|---|---|---|---|
| 3,128,093 | 4/1964 | Highsmith et al. | 271/305 |
| 3,472,506 | 10/1969 | Rabinow et al. | 271/304 |
| 3,944,207 | 3/1976 | Bains | 271/297 X |
| 3,947,018 | 3/1976 | Stange | 271/99 |
| 4,015,841 | 4/1977 | Mitsumasu | 271/297 |
| 4,056,264 | 11/1977 | Dhooge et al. | 271/184 X |
| 4,570,918 | 2/1986 | Eisler | 271/902 X |

OTHER PUBLICATIONS

Bullock, M. K., "Sheet Reverser", IBM Tech. Disc. Bulletin, vol. 20, No. 1, p. 22, (Jun. 1977).

*Primary Examiner*—George E. A. Halvosa
*Assistant Examiner*—Matthew C. Graham
*Attorney, Agent, or Firm*—Mark T. Starr

[57] ABSTRACT

A document stacker assembly including a plurality of document stackers each having a bin wherein documents are selectably stacked against a bin wall member. A belt moves documents along a document track and an idler wheel is pressed against the belt in each stacker assembly. A flicker wheel is driven to rotate by pressure thereagainst by the rotating idler wheel. A solenoid is operable selectably to move a document deflector pivoted about the flicker wheel axle to deflect a document along the track into the pinch between a central waisted portion of the flicker wheel and the idler wheel. The document is urged into the bin and the trailing edge of the document, having disengaged from the pinch between the idler wheel and a waisted portion of the flicker wheel is engaged by projections on the unwaisted top and bottom serrated portions of the flicker wheel, to urge the document further into the bin and to disengage the trailing edge at a predetermined location therein.

30 Claims, 9 Drawing Figures

SELF-ALIGNING DOCUMENT STACKER

BACKGROUND OF THE INVENTION

The present invention relates to a document stacking apparatus wherein mechanically or electronically processed documents are taken into and retained within a storage bin.

Document processing equipment is well known in processing documents wherefrom information is automatically to be read. The document is moved along a track past processing equipment which performs the reading or printing operations required for the document. In general terms, a stack of documents is supplied to a feeder bin, ducted along the document path for processing and finally stored in a storage bin in an output stack.

The present invention relates most particularly to check encoders, where checks are supplied from a feeder stack and data is read from the check and also supplied to the check. Thereafter, the processed checks are sorted into different stacks for further processing.

With increasing mechanization of the check sorting process, it is desirable to put the checks through a sequence of processes using a sequence of machines. When the checks are placed in the output stack there is generally no alignment between the edges of the various checks in the stack. It is, therefore, very difficult to take the output stack of one machine and place it as the input stack to a further machine.

There is also a trend towards making the document track in a document encoder bi-directional. That is to say, the documents can be made to travel in two directions along the track and around different portions of the track to have their processing completed in a short physical distance, the checks or documents encountering different processing operations in each pass along the track. Accordingly, it is desirable to provide a document stacker where the documents are stored in a bin and can be removed from that bin in the reverse direction for further processing in the document encoding equipment.

SUMMARY OF THE INVENTION

The present invention resides in a document stacking apparatus for stacking documents in a bin with the trailing edges thereof aligned in a predetermined position, said apparatus comprising: a document path; motive means for driving a document along said path; an idler wheel rotated by said motive means and co-operative to urge the document along said path; a deflector selectably operable to divert a document from said path towards said bin; and a flicker wheel, operative to induce a deflected document into said bin and to position the induced deflected document therein; said flicker wheel comprising a first portion at a first radius urged against said idler wheel for said flicker wheel to be rotated and for the deflected document to be trapped therebetween for said induction of the deflected document into said bin, and a second portion at a second radius greater than said first radius having a plurality of projections thereon extending to said second radius, for at least one of said projections to engage the trailing edge of the deflected document after passage of the document between said first portion of said flicker wheel and said idler wheel for said at least one of said projections to urge said trailing edge into said bin and to disengage from said trailing edge at said predetermined position.

In a preferred embodiment a document stacker assembly comprises a document path along which documents are driven by means of a drive belt supported on drive belt rollers, at least one of which is driven. A plurality of document stackers is provided along the document path. Each document stacker comprises a spring loaded idler wheel pressed against the drive belt and rotated thereby, trapping a document moving along the document path between itself and the drive belt. Each document stacker further comprises a flicker roller. The flicker roller is urged under spring tension towards the idler wheel. The flicker roller is waisted in its middle portion and has serrated top and bottom portions from which projections protrude. The idler wheel pressing against the waist of the flicker roller causes the flicker roller to rotate.

Each document stacker further comprises a document deflector mounted to rotate about the axis of the flicker roller. A solenoid is operative to move the document deflector from its neutral, spring retained first position wherein it does not impede a document from moving along the document path to a second deflecting position wherein it deflects a document moving along the path between the idler wheel and the flicker roller in its respective document stacker.

The document, initially deflected into a document stacker, is gripped between the waisted portion of the flicker roller and the spring loaded idler wheel. As the trailing edge of a document passes from between the small radius waisted portion of the flicker roller and the idler wheel, the projections on the top and bottom portions of the flicker roller engage the trailing edge of the document. The document, having so far been urged into a document retaining bin by being trapped between the waisted portion of the flicker roller and the spring loaded idler wheel, is now finally positioned within the document retaining bin by the projections on the top and bottom of the flicker roller urging the trailing edge of the document into the document retaining bin and disengaging therefrom when the document's trailing edge is a predetermined distance therein.

The projections on the flicker roller are preferably saw-tooth in shape, in which case the more steeply rising edge of the saw-tooth engage the trailing edge of the document. It is preferred that the steeply rising edges of the saw tooth are radial with respect to the flicker roller.

Each document retaining bin comprises a spring loaded wall for retaining the documents and for causing their deceleration when in the document stacker.

In a first variation of the preferred embodiment, both the spring loaded idler wheel and the flicker wheel have their own independent fixed shafts. In a second variation upon the preferred embodiment, the spring loaded idler wheel assembly of one stacker along the document path is mounted on an idler wheel yoke which is also suspended on the shaft of the flicker wheel, but in this instance on the flicker wheel of that document stacker in the plurality of documents stackers in the assembly adjacent thereto and earlier on the document path.

Each document stacker may be reversed with reversal of the drive belt in the document path to feed documents stored therein in the opposite direction back down the document path.

DESCRIPTION OF THE DRAWINGS

The present invention is further explained, by way of an example, by the following description taken in conjunction with the appended drawings in which.

DETAILED DESCRIPTION OF THE INVENTION

Figure 1:
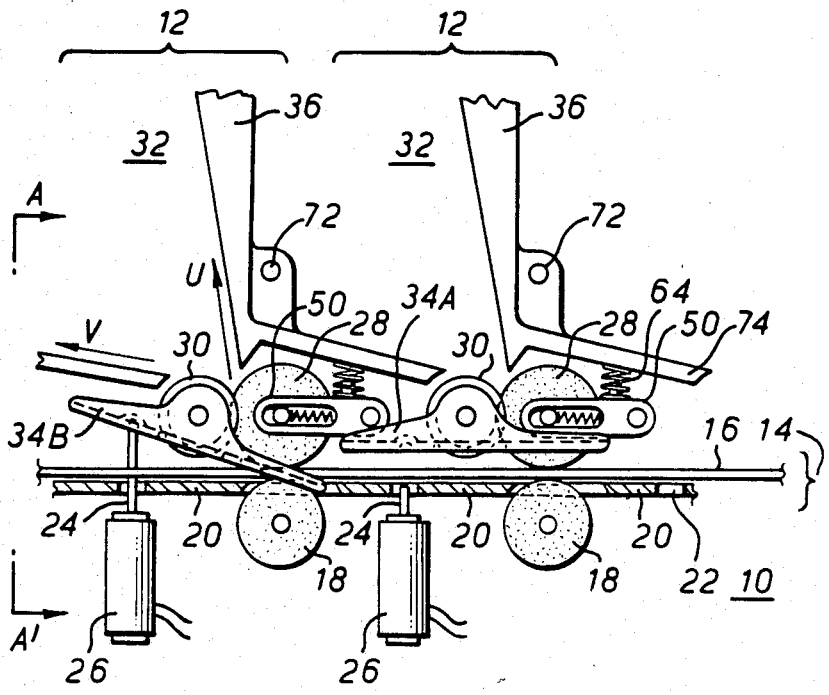
FIG. 1 shows a plan schematic view of a stacker assembly according to the first variation of the present invention.

FIG. 1 shows a plan view of the first preferred implementation of the preferred embodiment of the present invention. A document stacker assembly 10 comprises a plurality of document stackers generally indicated by the numeral 12. A document path 14 is provided in the form of a continuous drive belt 16 supported on drive belt rollers 18. The document path 14 further comprises a support wall 20 providing support for the drive belt 16. Apertures 22 in the support wall 20 are provided such that the shafts of each of the plurality of solenoids can penetrate therethrough. There is one solenoid for each document stacker 12.

At least one of the drive belt rollers 18 is a driven roller and belt 16 loops continuously about the plurality of such rollers to urge documents along the document path 14.

Each document stacker 12 is firstly provided with a spring loaded idler wheel 28, which pushes against the belt 16 in opposition to its respective drive belt roller 18. While in the preferred embodiment shown in FIG. 1 each idler wheel 28 presses against a portion of the belt 16 supported by a drive belt roller 18, it is to be understood that this is not absolutely necessary and the idler wheel 28 may equally press directly against a portion of the belt 16 not supported by a drive belt roller 18.

When a document such as a check is transported along the document path, it is gripped between the belt 16 and the idler wheel 28 to be moved along the path. The idler wheel 28 is in receipt of no motive power and is turned simply by friction against the belt 16 or, when a document is present between the idler wheel 28 and the belt 16, by friction against the document.

Each document stacker 12 is further provided with a flicker wheel 30 against which the spring loaded idler wheel 28 is also pressed. The spring loaded idler wheel 28 imparts rotational drive to the flicker wheel 30. The full function of the flicker wheel 30 will be explained later. The flicker wheel 30 provides a dual function of gripping a document between itself and the idler wheel 28 when a document is required to be put in the storage bin 32 of each stacker 12 and further serves to position the trailing edge of a document in a predetermined position within the storage bin 32.

Each stacker further comprises a document deflector 34. the document deflector 34 in each instance is mounted to rotate about the same axle as the flicker wheel 30. In FIG. 1, a first document deflector 34A is shown in its spring-restored rest position wherein it does not interfere with the movement of any document along the document path 14. A second document deflector 34B is shown in the deflecting position. The solenoid 26 is activated to extend its shaft 24 to engage the second document deflector 34B to turn it against its spring retaining torque into the path of the belt 16. When in this position, the document coming along the belt 16 is deflected between the flicker wheel 30 and the idler wheel 28.

Each stacker 12 further comprises a bin wall member 36 whose function is to act as a support for documents provided in each bin 32. The bin wall member 36 may be urged against the document by spring loading, or by gravity. Alternatively, the bin wall member 36 may be static and the documents urged thereagainst by a further spring loaded wall on each storage bin 32 or urged thereagainst by gravity. The function of the bin wall member 36, as will later be described, is to catch and engage each document as it enters a storage bin 32.

Figure 2:
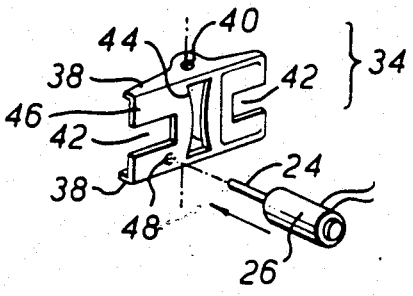
FIG. 2 shows a projected view of the solenoid and the document deflector of FIG. 1.

FIG. 2 shows detail of the document deflector 34 of FIG. 1. The document deflector 34 comprises upper and lower walls 38 extending above and below the flicker wheel 30 for pivot holes 40 therein to be supported upon the axle of the flicker wheel 30. First and second horizontal cutaways 42 allow the document deflector 34 to extend over the belt 16 when in a position to deflect a document into its respective stacker. A vertical cutaway 44 permits the flicker wheel 30 to protrude part way through a vertical wall 46 of the document deflector 34. When in the non-deflecting position, the vertical wall 46 of the document deflector 34 assists in forming a continuous wall to the document path 14. Document deflectors 34 in adjacent stacker assemblies 12 not positioned to receive a document assist in forming a near-continuous wall for guiding a document along the document path 14.

The shaft 24 of each solenoid 26 is shown in FIG. 2 as passing beneath the belt 16 to engage a recess in the document deflector 34. The document deflector 34 is spring-returned to the undeflected position by any manner known in the art which can include helical springs on the shaft of the flicker wheel 30, springs mounted on the body of the document stacker assembly 10 urging directly against each document deflector 34. Alternatively, the rotation of the flicker wheel 30 may be frictionally imparted to each document deflector 34 to bring it towards the undeflected position. In any instance, the document deflector 34 engages a mounting yoke 50 for the idler wheel 28 to be prevented from rotation beyond the non-deflecting position.

The shape of the upper and lower walls 38 of the deflector 34 is made such that the deflected document is caused to be directed to the pinch between the idler wheel 28 and the point where it contacts the flicker wheel 30. One of the horizontal cutaways 42 is designed such that the idler wheel 28 penetrates the vertical wall 46 of the document deflector 34 to rotate freely therein when the document deflector 34 is in the undeflected position. The horizontal cutaways 42 are advantageously made the same and the shape of the document deflector 34 chosen such that it may be mounted either way up on the axle of the flicker wheel 30. This, however, is not a necessary condition in the embodiment of the present invention and the two horizontal cutaways 42 may respectively be chosen one to clear the belt 16 and the other to clear the idler wheel 28.

Figure 3:
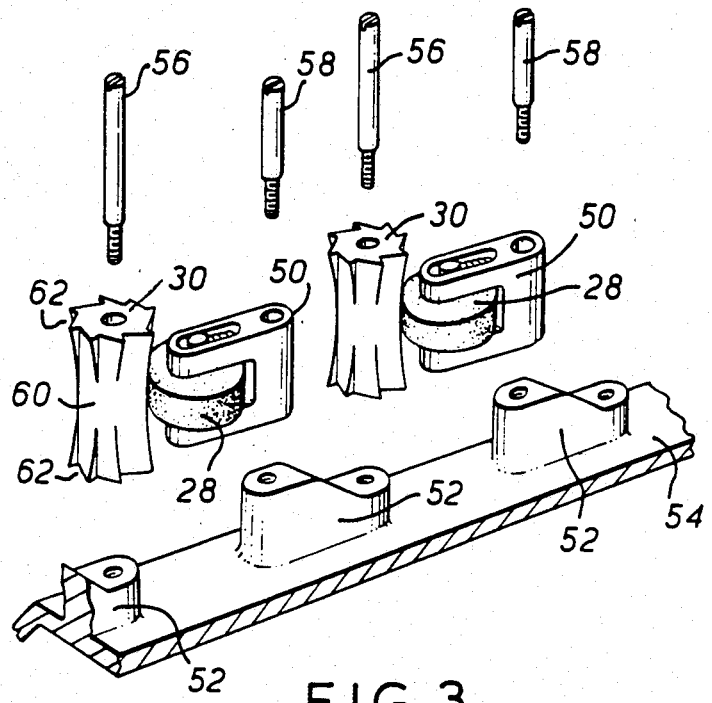
FIG. 3 shows how the spring loaded idler wheel and the flicker wheel of FIG. 1 are each held on their own respective shafts.

FIG. 3 shows a projected exploded view of the mutual relationship between the idler wheel 28 and the flicker wheels 30 of FIG. 1.

Each set of flicker wheels 30 and idler wheels 28 is mounted on adjacent pairs of mounting bosses 52 on the body 54 of the document stacker assembly 10. For each document stacker 12, the respective flicker wheel 30 is mounted on a first mounting boss 52 and the respective idler wheel 28 held in its mounting yoke 50 is held on the mounting boss 52 next adjacent thereto. A first axle 56 holds the flicker wheel on its respective mounting boss 52 and a second axle 58 passes through the vertical joining section of the mounting yoke 50 of the spring-loaded idler wheel 28 to hold the idler wheel assembly 28,50 on its respective mounting boss 52. When mounted, the idler wheel 28 engages the center portion of the flicker wheel 30.

As is shown in FIG. 3, the flicker wheel 30 is waisted having a central waist portion 60 of a first diameter and top and bottom serrated portions 62 having a second diameter greater than the first diameter.

As the idler wheel 28 rotates, it does so at the linear velocity of the belt 16. Similarly, the central waist portion 60 of the flicker wheel 30 will also rotate with a circumferential surface velocity equal to that of the belt 16. By contrast, the serrated portions 62 of the flicker wheel 30, being of greater diameter than the waisted portion 60, will have a velocity at the ends of the tips of the projections thereon which is greater than the linear velocity of the belt 16.

Figure 4:
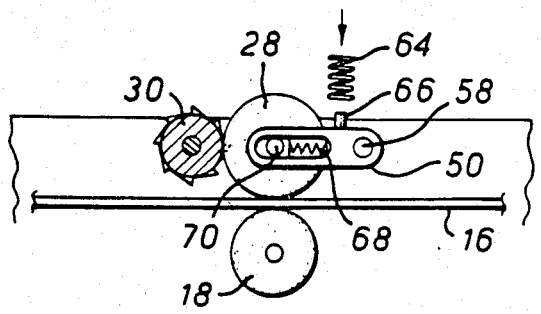
FIG. 4 shows details of the manner in which the idler wheel is urged against the belt of FIG. 1 and the waisted portion of the flicker wheel.

FIG. 4 shows the manner in which the idler wheel 28 is urged against the belt 16 opposite the drive belt roller 18 and also against the flicker wheel 30 in its waisted portion 60. FIG. 4 shows the view from above also shown in FIG. 1. A first idler wheel compressed spring 64 engages a spring projection 66 on the yoke 50 supporting the idler wheel 28 to urge the idler wheel counter-clockwise as seen in FIG. 4, pressing the idler wheel 28 against the belt 16 immediately opposite the drive roller 18. A second idler wheel compression spring 68 provided in two places, one in the top arm and one in the bottom arm of the yoke 50, urges an idler wheel support shaft 70 towards the flicker wheel 30 to press the idler wheel 28 against the waisted portion 60.

The first idler wheel compression spring 64 is shown in FIG. 1 advantageously employed in urging the bin wall member 36 against documents stored in the bin 32. The bin wall member 36 is provided with a pivot 72 which allows it to be rotated against stored documents in the bin 32. The first idler wheel compression spring 64 presses against an extending arm 74 of each bin wall member 36 to urge it against the stored documents in the bin 32. As the number of documents in the bin 32 increases, so the bin wall member 36 is urged clockwise as seen in FIG. 1, increasing the pressure on the first idler wheel compression spring 64 and thus urging the idler wheel 28 more forcefully against the belt 16 to increase frictional drive to documents as the bin 32 of each stacker assembly 12 becomes more full. This allows documents to be urged with more force into a bin already containing a number of documents than into a bin containing relatively few documents.

While this automatic compensation for bin 32 fullness is desirable in the present invention, the first idler wheel compression spring 64 might equally well be braced against the body 54 of the document stacker assembly 10. Other forms of torque inducement to the yoke 50 are contemplated and are known in the art. All that is required of them is that they urge the idler wheel 28 against the belt 16 in the manner shown.

Figure 5:
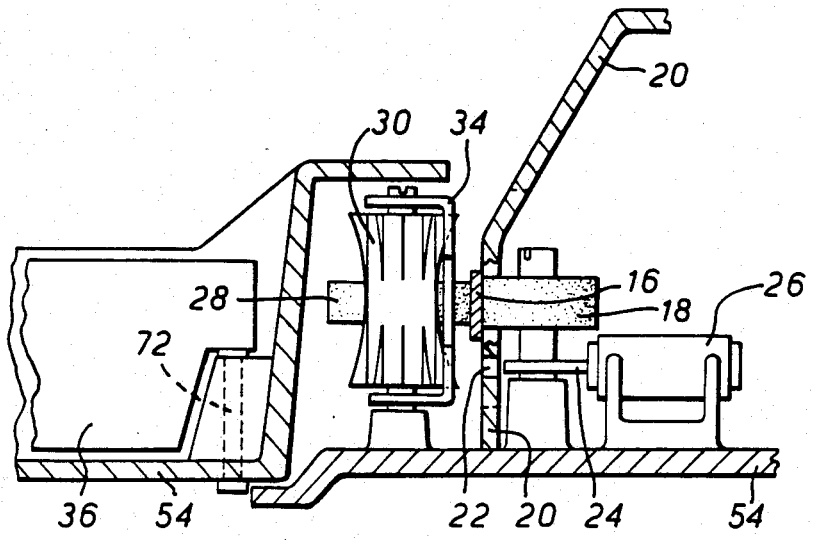
FIG. 5 shows an upright view of the apparatus of FIG. 1 looking along the line A—A' in the direction of the arrows.

FIG. 5 shows a vertical projected view of the apparatus of FIG. 1 viewed along the lines A—A′ looking in the direction of the arrows. The elements of FIG. 5 are simply those previously described. In particular, attention is drawn to the manner in which the flicker wheel 30 is clearly waisted. The drive belt roller 18 may be driven by means of a motor mounted beneath the body 54 of the stacker assembly. Alternatively, the shaft of drive belt roller 18 may extend beneath the body 54 of the document stacker assembly 10, in turn to be belt driven to provide motive power for the belt 16. The drive belt roller 18 may equally be a simple idler roller merely mechanically supportive of the belt 16 which is otherwise driven by a different drive belt roller 18 elsewhere in the document stacker assembly 10.

Figure 6:
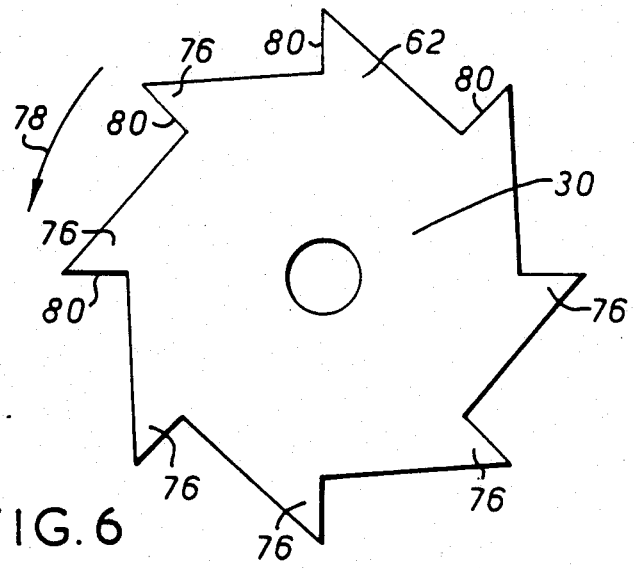
FIG. 6 shows the preferred form of the projections on the top and bottom portions of the flicker wheel of FIGS. 1 to 5 and represents a plan view looking down upon the flicker wheel.

FIG. 6 shows a view from above of the document flicker wheel 30, in particular showing the serrated portions 62.

The serrated portions 62 which may equally be found on the lower edge of the flicker wheel 30 comprises projections 76. The flicker wheel assembly 30 rotates as indicated by the arrow 78. The projections 76 are of a serrasoidal shape with the sharper face 80 of each projection 76 substantially radial on the flicker wheel 30.

In the overall operation of the stacker system, when it is desired to store a document moving along the document path 14 in one of the storage bins 32, the selected solenoid 26 is operated to extend its shaft 24 to move the selected document deflector 34 into the deflecting position. As a document moving along the belt 16 encounters the upper and lower walls 38 of the document deflector 34 with their selected tapered shape, so it is deflected into the pinch between the waisted portion of the flicker wheel 30 and the idler wheel 28. In being so gripped, the flicker wheel 30, by virtue of its being waisted, imparts a vertical curvature to the document which lends it geometric strength. The document is driven as indicated by the arrow U up against the bin wall member 36 which provides resilient opposition thereto. The slight curvature imparted to the document by the waisted flicker wheel 30 can be employed through its mechanical strength imparted to the document to urge the document into an otherwise resistant stack of documents already in a bin 32. As the trailing edge of the document to be inserted into a bin 32 clears the pinch between the idler wheel 28 and the waisted portion 60 of the flicker wheel 30, so it is engaged by the sharper faces 80 of the projections 76 on the upper and lower portions 62 of the flicker wheel 30. The sharper faces 80 (or at least one of them) co-operate in the upper and lower serrated portions 62 of the flicker wheel 30 to urge the trailing edge of the document further into the bin 34 and to disengage therefrom at a predetermined position. When another document is loaded into the bin 32, thereafter it is pushed in behind the previously-loaded document so that all following documents are similarly aligned with their trailing edges at the predetermined position.

While FIG. 6 has shown the projections to be of a preferred serrasoidal configuration, it is to be appreciated that this same action can be achieved using projections of other shapes. It is simply necessary that the projections 76 engage the trailing edge of a document as it leaves the pinch between the idler wheel 28 and the waisted portion 60 of the flicker wheel 30 and disengage therefrom when the document has reached a predetermimed position. The action of the projections 76 is to change a movement vector from the indicated by the arrow V to that indicated by the arrow U.

Figure 7:
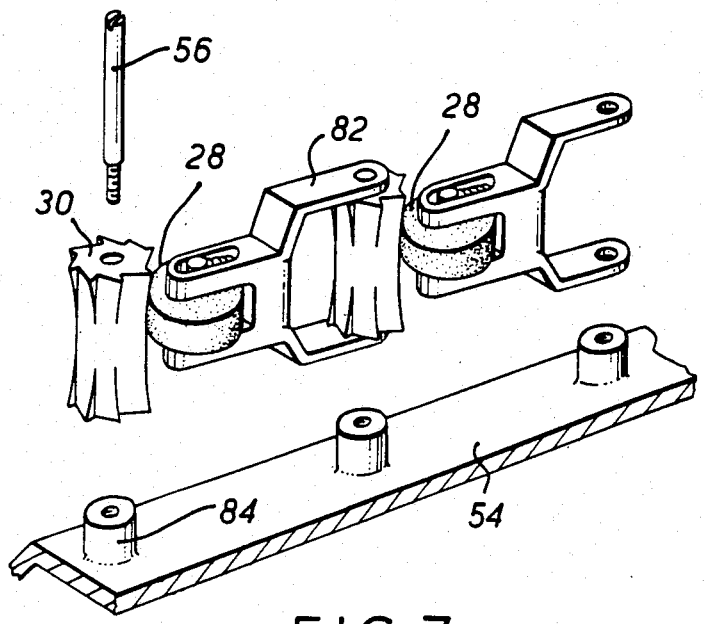
FIG. 7 shows an alternative manner in the form of a second variation of the preferred embodiment of mounting the idler wheel assembly and the flicker wheel using a single shaft for each document stacker.

FIG. 7 shows a second variation on the manner in which the idler wheel 28 and the flicker wheel 30 can be mounted. The idler wheel 28 is mounted upon a modified yoke 82 which instead of being pivoted about its own axle 58 as shown in FIG. 3, is pivoted instead about the first axle 56 by means of long extended arms. Everything is as before, save for the omission of the second axle 58 and modification to the mounting bosses 52 into a single modified boss.

Figure 8:
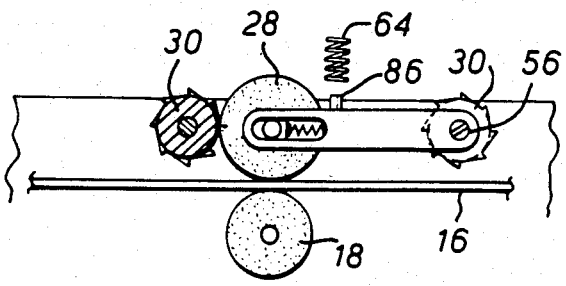
FIG. 8 shows the manner of spring loading the mounting arrangement of FIG. 7 to achieve the required urging of the idler wheel in its necessary directions.

FIG. 8 shows the urging of the idler wheel 28 against the belt 16 and flicker wheel 30 is once again achieved by the first idler wheel compression spring 64 which is placed on a modified spring projection 86 serving much the same purpose as the spring projection 66 shown in FIG. 4. In this instance, the fractional mechanical advantage afforded the first idler wheel compression spring 64 in FIG. 4 by virtue of the radius ratios between the second axle 58 and the spring projection 66 and the second axle 58 and the point of contact of the idler wheel 28 with the belt 16, is improved from the very high ratio shown in FIG. 4 to a much lower ratio shown in FIG. 8 where the first idler wheel compression spring 64 is working at a mechanical advantage of around 0.5. The elastic restitution coefficient of the first idler wheel compression spring 64 may thus be reduced if the configuration of FIGS. 7, 8 and 9 is adopted.

Figure 9:
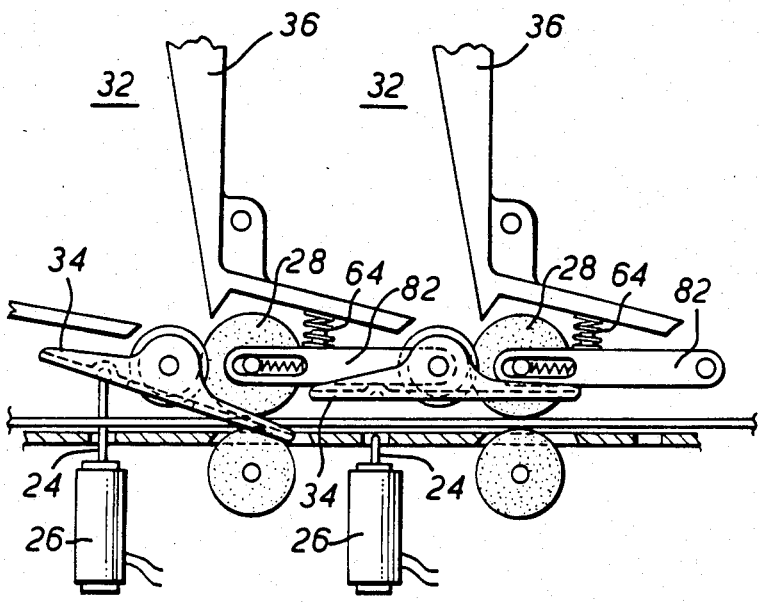
FIG. 9 shows a plan projected view of the complete document stacker assembly employing the second variation of mounting otherwise shown in FIG. 7.

FIG. 9 leastly shows a plan projection view corresponding in essence with that of FIG. 1 of the document stacker assembly 10, employing the idler wheel mounting method shown in FIGS. 7 and 8. Once again, the first idler wheel compression springs urge the bin wall members 36 towards each bin 32, but this time with a controllably reduced force. In the embodiment shown in FIG. 9, the mechanical advantage (that is the position along the modified yoke 82) of the first idler wheel compression spring 64 can be selected to give both the desired force upon the bin wall member 36 and upon the idler wheel 28.

All documents are thus aligned in the selected bin 32 with the trailing edges thereof in a predetermined position. The documents are then ready to be removed therefrom to be placed as a feeder stack in a further document processing operation.

Alternatively, it is possible to extract the documents from the stacker assembly shown by reversal of the belt 16 when the drive belt rollers 18 are made to rotate in the opposite direction. A deflector 34 in a selected document stacker may be moved by its associated solenoid 26 and means provided in association with the bin wall member 36, whereby an individual document from the stack held in a bin 32 may once again be fed into the pinch between the flicker wheel 30 and the idler wheel 28. The documents may then be ducted back along the document path 14 in its reverse direction to that which it originally entered the document stacker assembly 10 for further processing elsewhere in the document encoding equipment.

The serrated portions 62 of the flicker wheel 30 are shown in FIGS. 1, 2 and 9 as projecting through the vertical wall 46 of the deflector 34. While it is preferred that the projections 76 do not engage any document travelling along the document path 14 by virtue of the clearance of the flicker wheel 30 from the belt 16, the selection of the shape of the projections 76 to be saw tooth and the rotation of the flicker wheel 30 in the direction selected for it means that a document proceeding along the document path 14, should it be unfortunate enough to encounter and engage a flicker wheel 30, will only encounter the shallow slope of the saw tooth, the sharper slope 80 of each saw tooth rotating away from the document. Thus the projections 76 of the flicker wheel 30 are made to present no impediment to a document travelling along the belt 16 in the event of unexpected engagement therewith.

While in the present application the invention has been described with reference to check encoding equipment, it is to be understood that such a stacker system may equally be used with data bearing cards, official documents, and indeed any flexible documentshaped member which may require processing and stacking.

What is claimed is:

1. A document stacking apparatus for stacking documents in a bin with the trailing edges thereof aligned in a predetermined position, said apparatus comprising: a document path; motive means for driving a document along said path; an idler wheel rotated by said motive means and co-operative to urge the document along said path; a deflector selectably operable to divert a document from said path towards said bin; and a flicker wheel, operative to induce a deflected document into said bin and to position the induced deflected document therein; said flicker wheel comprising a first portion at a first radius urged against said idler wheel for said flicker wheel to be rotated and for the deflected document to be trapped therebetween for said induction of the deflected document into said bin, and a second portion at a second radius greater than said first radius having a plurality of projections thereon extending to said second radius, for at least one of said projections to engage the trailing edge of the deflected document after passage of the document between said first portion of said flicker wheel and said idler wheel for said at least one of said projections to urge said trailing edge into said bin and to disengage from said trailing edge of said predetermined position.

2. An apparatus according to claim 1, wherein said flicker wheel is waisted, wherein said idler wheel is urged against said portion at said first radius of said flicker wheel and wherein said portion of said flicker wheel at said second radius consists in a first upper portion and a second lower portion of said flicker wheel, said flicker wheel and said idler wheel being cooperative to impart curvature to the document trapped therebetween to give mechanical strength thereto as the document is urged into said bin.

3. An apparatus according to claim 2, wherein said motive means for driving a document along said path comprises a belt and two or more belt drive rollers.

4. An apparatus according to claim 2, wherein said deflector is mounted to rotate about the same axis as said flicker wheel.

5. An apparatus according to claim 2, further comprising a solenoid selectably operable to move a shaft across said document path to move said deflector from a first position wherein it forms a support wall for said document path into a second position wherein it is operative to deflect a document moving along said path into a pinch between said idler wheel and said flicker wheel.

6. An apparatus according to claim 2, wherein said flicker wheel is mounted on a first axle.

7. An apparatus according to claim 2, further comprising a bin wall member for urging against documents in said bin for the retention thereof, and an idler wheel compressed spring operative to urge said idler wheel against said motive means, said bin wall member being operative to cause said idler wheel compression spring more strongly to urge said idler wheel against said motive means the greater the number of documents contained within said bin.

8. An apparatus according to claim 1, comprising means for reversing the movement of documents along said document path and means for feeding aligned documents one by one from said bin back onto said document path.

9. An apparatus according to claim 8, further comprising a solenoid selectably operable to move a shaft across said document path to move said deflector from a first position wherein it forms a support wall for said document path into a second position wherein it is operative to deflect a document moving along said path into a pinch between said idler wheel and said flicker wheel.

10. An apparatus according to claim 1, wherein each of said projections is of a saw tooth shape with the sharper edge thereof operative to engage said trailing edge of the document.

11. An apparatus according to claim 10, wherein said sharper edge of said saw tooth projection is radial on said flicker wheel.

12. An apparatus according to claim 1, wherein said motive means for driving a document along said path comprises a belt and two or more belt drive rollers.

13. An apparatus according to claim 1 wherein said deflector is mounted to rotate about the same axis as said flicker wheel.

14. An apparatus according to claim 1, further comprising a solenoid selectably operable to move a shaft across said document path to move said deflector from a first position wherein it forms a support wall for said document path into a second position wherein it is operative to deflect a document moving along said path into a pinch between said idler wheel and said flicker wheel.

15. An apparatus according to claim 1, wherein said flicker wheel is mounted on a first axle.

16. An apparatus according to claim 15, wherein said idler wheel is mounted in an idler wheel yoke supported on a second axle.

17. An apparatus according to claim 15, wherein said idler wheel is mounted in an idler wheel yoke supported by said first axle.

18. An apparatus according to claim 1, further, comprising a bin wall member for urging against documents in said bin for the retention thereof, and an idler wheel compressed spring operative to urge said idler wheel against said motive means, said bin wall member being operative to cause said idler wheel compression spring more strongly to urge said idler wheel against said motive means the greater the number of documents contained within said bin.

19. A document stacking apparatus for stacking documents in a bin with the trailing edges thereof aligned in a predetermined position, said apparatus comprising: a document path; motive means for driving a document along said path; an idler wheel rotated by said motive means and cooperative to urge the document along said path; a deflector selectably operable to divert a document from said path towards said bin; and a flicker wheel, operative to induce a deflected document into said bin and to position the induced deflected document therein, said flicker wheel comprising a first portion at a first radius urged against said idler wheel and a second portion at a second radius greater than said first radius having a plurality of projections thereon extending to said second radius.

20. An apparatus according to claim 19, further comprising means for reversing the movement of documents along said document path and means for feeding aligned documents one by one from said bin back onto said document path.

21. An apparatus according to claim 19, further comprising a solenoid selectably operable to move a shaft across said document path to move said deflector from a first position wherein it forms a support wall for said document path into a second position wherein it is operative to deflect a document moving along said path into a pinch between said idler wheel and said flicker wheel.

22. An apparatus according to claim 19, further comprising a bin wall member for urging against documents in said bin for the retention thereof, and an idler wheel compressed spring operative to urge said idler wheel against said motive means, said bin wall member being operative to cause said idler wheel compression spring more strongly to urge said idler wheel against said motive means the greater the number of documents contained within said bin.

23. A document stacking apparatus for stacking documents in a bin with the trailing edges thereof aligned in a predetermined position, said apparatus comprising: a document path; motive means for driving a document along said path; an idler wheel rotated by said motive means and cooperative to urge the document along said path; a deflector selectably operable to divert a document from said path towards said bin; a flicker wheel, operative to induce a deflected document into said bin and to position the induced deflected document therein; and a solenoid selectably operable to move a shaft across said document path to move said deflector from a first position wherein it forms a support wall for said document path into a second position wherein it is operative to deflect a document moving along said path into a pinch between said idler wheel and said flicker wheel.

24. An apparatus according to claim 23, wherein said flicker wheel comprises: a first portion at a first radius urged against said idler wheel; and a second portion at a second radius greater than said first radius having a plurality of projections thereon extending to said second radius.

25. An apparatus according to claim 23, further comprising means for reversing the movement of documents along said document path and means for feeding aligned documents one by one from said bin back onto said document path.

26. An apparatus according to claim 25, further comprising a bin wall member for urging against documents in said bin for the retention thereof, and an idler wheel compressed spring operative to urge said idler wheel against said motive means, said bin wall member being operative to cause said idler wheel compression spring more strongly to urge said idler wheel against said motive means the greater the number of documents contained within said bin.

27. A document stacking apparatus for stacking documents in a bin with the trailing edges thereof aligned in a predetermined position, said apparatus comprising: a document path; motive means for driving a document along said path; an idler wheel rotated by said motive means and cooperative to urge the document along said path; a deflector selectably operable to divert a document from said path towards said bin; a flicker wheel, operative to induce a deflected document into said bin and to position the induced deflected document therein; a bin wall member for urging against documents in said bin for the retention thereof; and an idler wheel compressed spring operative to urge said idler wheel against said motive means, said bin wall member being operative to cause said idler wheel compression spring more strongly to urge said idler wheel against said motive means the greater the number of documents contained within said bin.

28. An apparatus according to claim 22, wherein said flicker wheel comprises: a first portion at a first radius urged against said idler wheel; and a second portion at a second radius greater than said first radius having a plurality of projections thereon extending to said second radius.

29. An apparatus according to claim 27, further comprising means for reversing the movement of documents along said document path and means for feeding aligned documents one by one from said bin back onto said document path.

30. An apparatus according to claim 28, further comprising a solenoid selectably operable to move a shaft across said document path to move said deflector from a first position wherein it forms a support wall for said document path into a second position wherein it is operative to deflect a document moving along said path into a pinch between said idler wheel and said flicker wheel.

* * * * *